United States Patent [19]

Louden

[11] 4,058,648

[45] Nov. 15, 1977

[54] DENSE PAPER

[76] Inventor: William G. Louden, Erwinna, Bucks County, Pa. 18920

[21] Appl. No.: 711,136

[22] Filed: Aug. 3, 1976

Related U.S. Application Data

[60] Division of Ser. No. 564,780, April 3, 1975, Pat. No. 3,989,416, which is a continuation-in-part of Ser. No. 397,220, Sept. 14, 1973, abandoned.

[51] Int. Cl.[2] ..... B05D 3/02; B32B 23/08; B32B 27/10

[52] U.S. Cl. ..... 428/511; 427/391; 427/439; 428/514; 428/537

[58] Field of Search ..... 427/391, 439; 428/511, 428/514, 537

[56] References Cited

U.S. PATENT DOCUMENTS

| | | | |
|---|---|---|---|
| 3,020,178 | 2/1962 | Sweeney et al. | 427/391 X |
| 3,813,262 | 5/1974 | Shelton | 427/439 X |

*Primary Examiner*—Michael R. Lusignan
*Attorney, Agent, or Firm*—Stanley B. Kita

[57] ABSTRACT

A dense paper comprising a web of cellulosic fibers and an impregnant dispersed throughout the web, the impregnant consisting essentially of a blend of a rigid polymeric material and an inorganic filler, in stated proportions, with the impregnant constituting a minor portion of the finished weight of the paper. A process for producing the paper is disclosed.

13 Claims, No Drawings

DENSE PAPER

The present application is a divisional of my application Ser. No. 564,780, filed Apr. 3, 1975 now U.S. Pat. No. 3,989,416 which is a continuation-in-part of application Ser. No. 397,220, filed Sept. 14, 1973 now abandoned.

BACKGROUND OF THE INVENTION

Papers of different densities have been provided for various purposes. Low density papers are soft and porous and have high absorbency unless treated to reduce absorbency. Medium density papers include papers utilized for writing, printing and wrapping purposes as well as bags and linerboards. Examples of high density papers include: glassine paper, grease-proff paper, vegetable parchment paper, vulcanized fiber paper and super-calendered paper.

An example of a dense writing paper is disclosed in my U.S. Pat. No. 3,839,144. Although that paper is dense and possesses excellent oil barrier properties, i.e. erasability, among other properties, it has certain limitations. For instance, the paper is not inexpensive to produce because it is manufactured from a furnish which is provided by heavily refining pulp to a predetermined Schopper-Riegler freeness and adding certain quantities of unrefined pulp thereto, or by combining alpha or cotton pulps with ordinary pulps and heavily refining the combined pulps, prior to the application of the furnish to the screen of a papermaking machine. It has been found that water drains relatively slowly from such heavily-refined furnishes so that it is very difficult to manufacture the desired dense paper at high machine speeds. Hence, it is more expensive to produce than other papers. Moreover, there is a limit on the maximum thickness of such a paper, and the necessity of heavily refining the pulp also increases the manufacturing cost of the paper.

Dense papers have certain desirable properties, including high tensile and burst (Mullen) strengths, improved folding endurance, improved interfiber bonding and delamination resistance, solvent and oil penetration resistance, and good abrasion resistance and rigidity. On the other hand, dense papers have low tear strengths, brittleness, poor dimensional stability and aging qualities and high manufacturing costs. For instance, vegetable parchment papers, and papers manufactured by the so-called vulcanized fiber processes, although dense, have relatively low tear strengths, as do dense papers manufactured by super-calendering webs of medium density.

DESCRIPTION OF THE PRIOR ART

In the papermaking art, papers of relatively low densities have been impregnated with polymeric resins. Such papers, however, usually have pre-impregnation densities, expressed as the weight per mil of thickness (based on 500 sheets 24 × 36) of 6–7 lbs/mil and even as low as 5 lbs/mil. After impregnation, the papers are still relatively porous, even though the amount of resin impregnated may exceed 50% of the weight of the paper on a dry solids basis. Because of its porosity and low density, such a paper is not suitable for use as an erasable typing paper nor does it have solvent hold-out properties.

The polymeric resins which have been used as coatings and impregnants for low density papers have been relatively soft and elastic in nature, as distinguished from hard and inelastic polymeric resins. The Thermal Glass Transition Temperature (Tg) is a measure of the rigidity, or film stiffness of a polymeric resin. This is the temperature which corresponds to the temperature at which the resin forms a continuous film. For instance, the glass transition temperature of relatively soft and elastic polymeric resins is less than about 0° C. Rigid or stiff and inelastic polymers, on the other hand, have glass transition temperatures in excess of about 15° C.

Papers of 8 lbs/mil or greater have been impregnated with rigid polymeric materials and have been found to possess certain desirable characteristics. For instance, such papers have improved tensile and burst strengths, abrasion resistance, resistance to delamination, solvent and grease penetration resistance, and good fold endurance. On the other hand, such papers have certain undesirable characteristics which make them unsuitable for use as typing papers or in applications where dense papers are desired. Such undesirable characteristics include reduced tear strength, poor writing qualities, and increased brittleness. Since dense paper webs do not accept as much impregnant as porous paper webs, it is generally believed that increases in the physical properties of a paper due to impregnation may be realized only when the web is porous and the resin content of the finished paper exceeds about 50% of its weight.

Tests have shown that the density of a paper web prior to impregnation and the amount of resin impregnated in the web affect the reduction of tear strength which accompanies impregnation of a paper with a rigid polymer. For example, sheets of base papers having various initial densities were impregnated with an aqueous dispersion of a rigid homopolymer polyvinyl acetate resin (PVAC) sold under the trade designation VINAC 880 by Air Products and Chemical Co. of Allentown, Pa. The dispersion contained 40% by weight of VINAC 880. Impregnation was effected by dipping the sheets into the aqueous dispersion and then passing the sheets through squeeze rollers to remove excess impregnant. The sheets were dried for 4 minutes each in a Williams paper sheet dryer at 220° F., 2 minutes each side. After conditioning for several days, the basis weight and caliper of each sheet was measured, and the tear strength of each sheet before and after impregnation was measured. The results are set forth below:

| Sample | Initial Density (lb/mil) | PVAC in Sheet (%) | Impregnated Density | Change in Tear (%) |
|---|---|---|---|---|
| A | 5.5 | 48.5% | 9.1 | gain 20% |
| B | 8.2 | 41.5% | 12.8 | loss 33% |
| C | 8.7 | 38.6% | 12.1 | loss 43% |
| D | 9.3 | 42.1% | 13.7 | loss 37% |
| E | 9.8 | 30.1% | 13.3 | los 25% |

From the above, it should be apparent that when dense papers are impregnated with rigid polymeric materials, they experience significant decreases in tear strength. This is unfortunate since other properties of paper, such as tensile and burst strength, abrasion resistance, and delamination resistance are at their maximum when the paper is dense.

In U.S. Pat. No. 3,634,298 issued to R. A. Wamsley, et al., there is disclosed a coating composition for paper. The composition includes a rigid polymeric material (having a glass transition temperature (Tg) in a range of about 85° to 110° F.) blended with a clay slip. The composition is applied as a coating onto a paper web to produce a high gloss paper.

OBJECTS OF THE INVENTION

With the foregoing in mind, it is a primary object of the present invention to provide a novel paper having the desirable physical properties of dense papers but without the undesirable properties thereof.

It is another object of the present invention to provide dense papers which are capable of being manufactured economically at relatively high papermaking machine speeds.

As another object, the present invention provides a novel dense paper which is oil and solvent resistant, resistant to tearing, abrasion resistant, and which has high folding endurance.

It is another object of the present invention to provide a unique paper which is useful as a cover stock for books or as a carrier for release coatings, among other applications.

A further object of the present invention is to provide an improved process for producing dense papers.

It is a more specific object of the present invention to provide an inexpensive dense paper which has been impregnated with a sufficient quantity of a rigid polymeric material to provide oil and solvent resistance without significantly reducing its tear strength and abrasion resistance.

SUMMARY OF THE INVENTION

According to the present invention, most of the disadvantages which are associated with the impregnation of a paper web with a rigid polymer are ameliorated, and a dense paper having increased folding endurance, excellent oil barrier properties, good tear and burst strengths, as well as solvent penetration resistance and abrasion resistance is provided. To this end, it has been discovered that such properties are provided when a web of paper having an uncalendered dry density of about 7–11 lbs/mil is impregnated with an aqueous dispersion consisting essentially of a rigid polymeric material and a mineral filler material blended together in predetermined proportions. The impregnant is dispersed throughout the thickness of the web, and preferably, the impregnant constitutes about 8.5 – 50% of the finished weight of the paper. The filler is in a range of 10–65% of the weight of the impregnant, and preferably in a range of 20–65%. The polymer has a rigidity or film hardness as determined by its glass transition temperature, of between 15°–60° C., and preferably between 22°–44° C. Preferred polymers include: polyvinyl acetate, polyacrylate, and polyvinyl chloride. Preferred inorganic fillers include: clay, calcium carbonate, mica and talc.

The paper of the present invention has certain properties which are unexpected of an impregnated dense paper. For instance, the paper of the present invention which has been impregnated with an extended-rigid polymer, has a folding endurance which is far superior to the folding endurance of a paper impregnated with a rigid polymer only. Impregnation of a dense base paper with a rigid polymer would normally significantly reduce the tear strength of the resulting paper. However, a base paper impregnated according to the present invention surprisingly retains a significant amount of its tear strength while at the same time possessing excellent oil barrier properties. By utilizing an impregnant which includes substantial amounts of filler, the manufacturing cost of the paper is lowered by reducing the total amount of polymer required to provide the desired properties, since the higher cost polymer is replaced by lower cost fillers. However, even though the paper may be inexpensive to manufacture, it has all of the desirable properties of dense papers which are more expensive to manufacture.

It is desirable for the paper web to be impregnated as it advances in the papermaking process such as encountered in a Fourdrinier machine wherein a furnish of cellulosic papermaking stock is applied onto a moving wire and formed into a web before being separated from the wire and dried. The impregnating step should occur after the web has formed and become coherent and at least partially dried, and the web may be impregnated after the paper has been completely dried and rolled, for instance as a subsequent post-manufacturing step. Preferably, the paper web is impregnated at the size press of a conventional papermaking machine. It is necessary for the density of the paper web to be controlled in the customary manner so that prior to impregnation its dry uncalendered density is in a range of 7–11 lbs/mil, and preferably 8.5 – 10.5 lbs/mil. The web is advanced through an aqueous dispersion which contains 12.5 –40% by weight of the impregnant, and after impregnation, the web is heated to fuse the impregnant in the web. The impregnant may also be blended with the paper stock at the "wet end" of the machine before web formation.

DESCRIPTION OF THE PREFERRED EMBODIMENT

In manufacturing paper according to the present invention, the polymeric material must have a predetermined minimum rigidity, i.e. brittleness or film stiffness which, as determined by its glass transition temperature (Tg) must exceed about 15° C. Rigid polymeric materials capable of functioning satisfactorily include: polyvinyl acetate copolymer latices such as RESYN 1105 and 1255 manufactured by National Starch and Chemical Corp. of New York, N.Y., and VINAC 880, a homopolymer, manufactured by Air Products and Chemicals Co., Allentown, Pa. Suitable polyacrylate materials include RHOPLEX AC 201 and TR 407, manufactured by Rohm and Haas Company of Philadelphia, Pa. A suitable polyvinyl chloride material is GEON 351 manufactured by the B.F. Goodrich Chemical Company of Akron, Ohio. Each of the aforementioned polymeric materials is of the commercially-available grade and is sold for use in papermaking applications. It is noted that the polymeric materials may be copolymers or may include certain amounts of other polymers or mixtures of one another; however, as long as the glass transition temperature of the polymeric material is within the aforesaid range, satisfactory results should be realized.

The inorganic filler material which is blended with the rigid polymeric material to form the aqueous dispersion is preferably a finely-divided mineral filler of commercial grades which are sold for use in papermaking applications. Preferred particle sizes for the fillers range between 2-5 microns. Examples of mineral fillers which have been tested and found satisfactory are kaolin clay, calcium carbonate, mica, and talc.

The amount of impregnant contained in the finished paper must be within a predetermined range. For instance, the impregnant should be between about 8.5 and about 50%, by weight, of the total finished weight of the paper on a dry solids basis. If the amount of impregnant is below the lower limit, the resulting paper has poor erasability. On the other hand, due to the density limitations of the base paper, it is difficult to impregnate the paper beyond the upper limit. Preferably, the impregnant is within a weight range of about 15% to about 40%. The uncalendered finished density of the impregnated paper should be between about 10.5 and 14.0 lbs/mil (500 sheets 24 × 36).

In order to provide the desired physical properties of the paper of the present invention, it is necessary for the rigid polymeric material to be extended within prescribed limits with one of the aforementioned mineral fillers or blends thereof. For instance, the filler should constitute between about 10 and and about 65% of the solids weight of the impregnant, and preferably, the filler material should make up between about 20 and about 65% of the weight of the impregnant. The balance of the weight of the impregnant is provided by the rigid resin, so that the resin constitutes between 35 and 90% and preferably between 35 and 80% of the weight of the impregnant. It has been found that as the percentage of filler decreases below the lower limit of its preferred range, the tear strength of the paper decreases significantly. On the other hand, as the percentage of filler increases above the upper limit of its preferred range the oil barrier and solvent resistance properties of the resulting paper tend to diminish.

The paper of the present invention is manufactured on a conventional papermaking machine, such as a Fourdrinier machine. In such a machine, a furnish of papermaking stock is laid on an advancing wire screen, and after the furnish has been formed into a web, the web is removed from the screen and passed over a series of heated drying rollers to dry. It is customary for the web, when at least partially dried, to be subjected to further processing, including the application of sizing at a size press located downstream of the drying rollers.

In manufacturing the paper of the present invention, it is desirable for the impregnating step to occur after the web has become coherent as by being at least partially dried. Preferably, the web is impregnated at the size press; however, the impregnation step may occur at a later stage in the paper manufacturing process. As well known to those skilled in the art, two types of size presses are in widespread use in the papermaking industry, and either type may be utilized satisfactorily to effect impregnation of the paper made in accordance with the process of the present invention. For instance, there is the so-called horizontal size press and the so-called vertical size press. In the horizontal size press, a pair of opposed rolls are mounted for rotation on horizontally-spaced axes, and the paper web is advanced vertically downward between the rolls as they apply pressure to opposite surfaces of the web. The impregnant forms a pool between each side of the paper web and the roll engaging that side. In the vertical size press, on the other hand, the rolls are mounted for rotation on vertically-spaced axes, and the paper web advances horizontally between the rolls. The lower roll rotates in a trough, picks up the impregnant, and applies the same to the underside of the web, while impregnant is flowed onto the upperside of the paper web, for instance by pumping the impregnant from a reservoir. In both types of apparatus, pressures in a range of 50 – 250 pounds/-linear inch are applied to the web as it advances between the rolls, and the rolls cooperate to force the impregnant into the web while removing excess impregnant from opposite surfaces of the web.

Regardless of the stage of the process at which impregnation occurs, it is important for the resin-filler blend to be dispersed throughout the thickness of the web in order for the full advantages of the present invention to be realized. The advantages cannot be realized if the blend is merely applied as a coating on the surface of the web, such as by an immersion roll and doctor system referred to in U.S. Pat. No. 3,634,298, for applying a coating onto a web. In such a system the lower periphery of a roll rotates in a trough containing coating, and the upper periphery engages the underside of the advancing web. Thus, the roll picks-up the coating from the trough and applies it onto the underside of the web. The thickness of the coating is controlled by passing the coated web over a doctor blade downstream of the roll to allow only a certain amount of coating to remain on the undersurface of the web.

The resin filler blend may even be admixed with the paper stock before application of the furnish onto the wire screen.

In order to ensure dispersion of the blend throughout the web, there are certain conditions which must be observed in the manufacturing process. For instance, prior to impregnation, the dry uncalendered density of the web must be controlled so that it is in a range of between 7 and about 11 lbs/mil. The density may be controlled by a variety of techniques, all of which are well known to those skilled in the art. The control of the pre-impregnation density is important, because when the dry uncalendered density is below 7 lbs/mil, the resulting paper is too porous. On the other hand, when the dry uncalendered density is about 11 lbs/mil, the web is incapable of absorbing a sufficient amount of impregnant to provide the desired properties.

Another important step in the manufacture of the paper of the present invention is the necessity of controlling the amount of solids present in the aqueous dispersion through which the web is passed. For instance, the solids content, which includes the combined weight of the rigid polymeric material and filler, should be in a range of between about 12.5% and about 60% of the total weight of the dispersion. If the combined weight is below the lower limit, webs within the above-stated density range (7–11 lbs/mil) do not acquire a sufficient amount of impregnant to provide the desired results. On the other hand, if the percentage is above the upper limit, the dispersion tends to become viscous and the resin-filler blend tends to coat the surface of paper webs having densities close to the 11 lbs/mil upper limit rather than to impregnate the same.

The paper web is subjected to a heating step after impregnation to fuse the impregnant in the paper. In the conventional papermaking process, the web is heated to a temperature of about 100° C. to dry the same so that rigid polymers which have glass transition temperatures in excess of that temperature would not provide satisfactory results. Preferably, the upper limit for the glass transition temperature of rigid polymeric materials employed in the present invention is less than about 60° C.

Certain advantages are realized in manufacturing paper according to this process. For instance, the use of a rigid polymeric impregnant heavily extended with fillers tends to kill the tackiness of the impregnant and renders the drying drums easier to clean.

SUMMARY OF THE EXAMPLES

The importance of the aforementioned factors in the manufacture of the paper of the present invention should become apparent from the following examples. In brief, Examples I and II demonstrate the permissible degree of extension of a rigid polymeric material with a mineral filler. In Example III, the importance of the rigidity of the polymer is set forth. The types of fillers which are required to provide satisfactory results are exemplified in Example IV. The necessity of controlling the pre-impregnation density of the paper web is set forth in Example V. The amount of impregnant which is required to provide the desired properties is presented in Example VI. The types of rigid polymeric materials which are required are demonstrated in Example VII. Example VIII demonstrates the abrasion resistance properties of the paper of the present invention. Example IX demonstrates the properties of a paper impregnated with a composition according to the present invention as compared with a paper coated with the same composition.

EXAMPLE I

For the purpose of determining the limits of the permissible extension of the resin with a mineral filler, sheets of unsized paper made from a blend of 50% bleached hardwood kraft and 50% bleached Northern kraft were used as base papers. The basis weight of the paper was 51.8 lbs., which is the weight of 500 sheets measuring 24 × 36. The caliper or thickness of a single sheet of the paper was 0.0055 (5.5 mils). Since the density of a paper may be conveniently expressed as its weight per mil of thickness, the density of the base paper was 51.8 lbs/5.5mil, or approximately 9.4 lbs/mil. The impregnant was prepared by dispersing finely ground calcium carbonate powder having a particle size of about 2 microns in water and agitating the same. A finely divided rigid polyvinyl acetate emulsion was blended with the aqueous dispersion so that the total solids content of the resin and filler was 40% by weight of the dispersion. The calcium carbonate which was used is sold under the trade designation CAMEL WHITE by the Harry T. Campbell Sons Co., Towson, Md. The polyvinyl acetate emulsion which was used is sold under the trade designation VINAC 880 by the Air Products and Chemical Company, Allentown, Pa.

The paper sheets were dipped in the dispersion, and after withdrawal were passed through rubber rollers where the excess was squeezed from the sheets. The impregnated sheets were then dried for 4 minutes at 220° F., 2 minutes for each side in a Williams paper sheet dryer. The sheets were permitted to condition (cure) for several days before being tested. The tear, Mullen and fold tests were conducted according to TAPPI standard procedures identified in Table I. The oil barrier properties were determined by typing a character on the paper with a commercial portable typewriter and observing the difficulty or ease with which the character could be removed by rubbing with a pencil eraser. Since inks in conventional typewriter ribbons contain substantial amounts of non-dring oils, there is a direct correlation between the erasability of a paper and its oil barrier properties. A determination of "excellent" meant that essentially all of the character was erased with a few rubs. A rating of "good" meant that the character remaining after a few rubs was observable but not apparent to the naked eye after another character was typed over the erased character. A rating of "fair" meant that erasure was acceptable. A rating of "poor" indicated unsatisfactory erasure.

The solvent resistance properties of the sheets were determined by placing a drop of dyed (purple) toluene on the surface of each sheet and allowing it to contact a predetermined area for 30 seconds. The drop of toluene was then wiped away with a paper towel, and the area was rubbed with another paper towel saturated with undyed toluene. This causes the dye remaining on the surface to be removed so that the amount of penetration of the paper may be determined by observing the presence of the remaining purple dye. A rating of "good" meant that there had been penetration at several points but that the degree of staining was light and less than about 50% of the test area. A rating of "fair" meant that light staining had occurred over most of the test area. A rating of "poor" meant that the entire test area became darkly stained. A rating of "none" was given if the stain completely penetrated to the back of the paper sheet.

The results of the tests are set forth in Table I. It is noted that the notation XD means that the test was conducted in the cross machine direction of the paper. The units of measure, as well as the identifying numbers on the standard test procedures employed in the various examples are set forth in Table I.

TABLE I

| | Filler Content And Physical Properties $CaCO_3$/Polyvinyl Acetate | | | | | |
|---|---|---|---|---|---|---|
| Sample | Ratio $CaCo_3$/PVAC | Tear[1] (XD) | Fold[2] (XD) | Mullen[3] | Oil Barrier[4] | Solvent Resistance[5] |
| A. | 0/100 | 80 | 3171 | 78 | Excellent | Excellent |
| B. | 10/90 | 91 | 3610 | 75 | Excellent | Excellent |
| C. | 20/80 | 112 | — | 75 | Excellent | Excellent |
| D. | 30/70 | 105 | 6013 | 75 | Excellent | Excellent |
| E. | 40/60 | 117 | 5585 | 74 | Good | Excellent |
| F. | 60/40 | 95 | 4435 | 71 | Good | Good |
| G. | 70/30 | 96 | 3429 | 64 | Fair | Fair |
| H.* | — | 147 | 111 | — | None | None |

* Paper prior to treatment
[1]TAPPI Standard Test No. T414ts-64, units in grams (g.)
[2]TAPPI Standard Test No. T423os-50, units in folds to failure (f.)
[3]TAPPI Standard Test No. T-403, units in pounds per square inch (psi)
[4]See infra page 15.
[5]See infra page 15 and 16.

In the above table, it may be observed that a paper sheet prior to treatment (sample H) had a tear strength of 147 grams. A similar sheet which had been impregnated with a 100% solution of polyvinyl acetate (sample A) had a tear strength of 80 grams. However, it should be noted that when the impregnant had been extended with calcium carbonate in the range of between 10–70% as indicated by samples B–G, the tear strengths of the sheets decreased, but not to the same degree as was observed when the impregnant was 100% polyvinyl acetate. The oil barrier and solvent resistance properties were retained even though the impregnant had been extended up to about 70% of its weight with calcium carbonate. Moreover, it is noted that the fold endurance of the extended-resin impregnant was greater than that measured when the impregnant was 100% polyvinyl acetate.

EXAMPLE II

The test procedure described above with respect to Example I was repeated; however, kaolin clay was employed as a mineral filler in place of the calcium carbonate. The clay utilized is sold under the trade designation HYDRAPRINT by the J. M. Huber Corporation, Huber, Ga. The results of the tests are summarized in Table II.

TABLE II

| Filler Content and Physical Properties Clay/Polyvinyl Acetate | | | | | |
|---|---|---|---|---|---|
| Sample | Ratio Clay/PVAC | Tear (g) (XD) | Fold (f) (XD) | Oil Barrier | Solvent Resistance |
| A. | 0/100 | 80 | 3171 | Excellent | Excellent |
| B. | 20/80 | 117 | — | Excellent | Excellent |
| C. | 30/70 | 114 | 4179 | Excellent | Excellent |
| D. | 40/60 | 117 | — | Good | Excellent |

From the foregoing tests, it should be apparent that kaolin clay and calcium carbonate have substantially the same effect as fillers on the properties of a base paper when blended with a rigid polymeric material and impregnated in the base paper.

EXAMPLE III

For the purpose of demonstrating the importance of impregnating the paper web with a polymer of a predetermined rigidity, the base paper of Example I was impregnated with a series of polymer-filler blends differing only in the thermal glass transition temperature (Tg) of the polymer. As noted heretofore, the Tg is a measure of the rigidity or film stiffness of a polymeric material. In the example, the polymer was extended with calcium carbonate, 60% polymer and 40% calcium carbonate.

The results are set forth below in Table III.

TABLE III

| Polymer Elasticity As Measured By Glass Transition Temperature And Physical Properties - Vinyl Acetate and Polyacrylate Materials (40% $CaCo_3$/60% Polymer) | | | | | | | | |
|---|---|---|---|---|---|---|---|---|
| Commercial Polymeric Materials | Impregnant (%) | Final* Density (lb./mil) | Tg (° C) | Tear (g) (XD) | Burst (psi) (Mullen) | Fold (f) (XD) | Oil Barrier | Solvent Resistance |
| Polyacrylates | | | | | | | | |
| Rhoplex B-85 | 26.3 | 10.8 | 101+ | 101 | 23 | 27 | None | None |
| Rhoplex AC201 | 32.7 | 13.0 | 29° | 94 | 73 | 1761 | Excellent | Good |
| Rhoplex TR407 | 28.3 | 12.1 | 22° | 89 | 79 | 4093 | Excellent | Good |
| Rhoplex B 15 | 26.3 | 12.6 | 0° C. | 97 | 57 | 3589 | Poor | Poor |
| Rhoplex E491 | 29.1 | 13.2 | <0° C. | 113 | 61 | 1752 | None | Poor |
| Polyvinyl Acetates | | | | | | | | |
| Resyn 1105 | 27.7 | 12.5 | 44° C. | 86 | 72 | 1927 | Good | Good |
| Vinac 880 | 38.2 | 12.3 | 31° C. | 117 | 74 | 5585 | Good | Excellent |
| Resyn 1255 | 29.1 | 12.0 | 16° C. | 109 | 67 | 1371 | Fair | Fair |
| Resyn 5000 | 31.7 | 12.3 | 2.0° C. | 114 | 70 | 2744 | Poor | Fair |
| Resyn 2873 | 24.6 | 12.7 | −36° C. | 122 | 45 | 189 | None | Poor |

*uncalendered

Referring to the above data, it can be seen that a sheet of paper impregnated with a polyvinyl acetate having a Tg of 16° C. has fair oil barrier properties and fair solvent resistance. On the other hand, a sheet of paper impregnated with a polyacrylate having a Tg of 101° C.+ does not have any oil barrier properties or solvent resistance. Accordingly, it should be apparent that a satisfactory polymeric material should have a rigidity, i.e., Tg which is within this range, about 15° C. to about 100° C., and preferably the Tg should not exceed about 60° C. (See Table VIII regarding a polyvinyl chloride having a Tg of 60° C.) if satisfactory results are to be ensured. The preferable Tg range is between 22° C. and 44° C. to ensure fusion of the polymer at conventional papermaking processing temperatures.

EXAMPLE IV

The types of mineral fillers employed as extenders have an important bearing on the properties of the impregnated paper. This should be apparent from the present example wherein the base paper of Example I was impregnated with the polyvinyl acetate which had been blended with a series of different mineral fillers. Each blend consisted of 40% filler and 60% polyvinyl acetate on a dry solids weight basis. The calcium carbonate and clay were the same as employed in previous examples; the talc which was employed is sold under the trade designation MISTRON VAPOR by the United Sierra Division, Cypress Mines, Trenton, N.J.; the mica is sold under the trade designation DAVENITE MICA P-12 by the Hayden Mica Co., of Wilmington, Mass.; and the diatomaceous earth is sold under the trade designation of CELLITE by Johns-Manville Corporation, New York, New York. Each of the aforementioned fillers is of a commercial grade and quality normally utilized in papermaking applications, having particle sizes in the 2–5 micron range.

The results of the test are set forth in Table IV.

TABLE IV

| Various Fillers 60% Polyvinyl Acetate/40% Filler | | | | | | | |
|---|---|---|---|---|---|---|---|
| Filler Used | Impregnant (%) | Impregnated** Density (lb./mil) | Tear (g) (XD) | Fold (f) (XD) | Burst (psi) (Mullen) | Oil Barrier | Solvent Resistance |
| None | 31.7 | 13.7 | 80 | 3171 | 78 | Excellent | Excellent |
| $CaCO_3$ | | | 117 | 5585 | 74 | Good | Excellent |
| Clay | | | 117 | 4179* | | Good | Excellent |
| Talc | 34.5 | 12.3 | 101 | 3334 | 84 | Good | Fair |

TABLE IV-continued

| Filler Used | Impregnant (%) | Various Fillers 60% Polyvinyl Acetate/40% Filler Impregnated** Density (lb./mil) | Tear (g) (XD) | Fold (f) (XD) | Burst (psi) (Mullen) | Oil Barrier | Solvent Resistance |
|---|---|---|---|---|---|---|---|
| DAVENITE Mica P-12 | 32.4 | 12.1 | 99 | 2825 | 81 | Good | Excellent |
| CELLITE Diatomaceous Earth | 32.4 | 11.6 | 100 | 2234 | 84 | Poor | Poor |

*30% Clay
**uncalendered

From the above table, it should be apparent that calcium carbonate, clay, talc, and mica provide satisfactory fillers; whereas, diatomaceous earth is unsatisfactory because the resulting paper provides poor oil barrier properties and poor solvent resistance.

EXAMPLE V

The importance of controlling the density of the paper web prior to impregnation is illustrated in the present example. An aqueous dispersion of polyvinyl acetate and calcium carbonate was prepared as in Example I. The polymer-filler blend constituted 40% of the weight of the dispersion, and the ratio of polymer to filler was 60/40 on a weight basis. A series of sheets of unsized paper of different densities were dipped into the dispersion, and the excess impregnant was removed from the sheets by passing them through rubber rollers and blotting the surface of the sheets with paper towels to ensure the removal of excess impregnant from the surface of the sheets. The sheets were thereafter dried for 4 minutes at 220° F., conditioned for several days, and tested as noted heretofore. For comparison purposes, a dispersion was prepared wherein only polyvinyl acetate was present at 40% by weight solids, and a second set of base papers were similarly impregnated. As a further comparison, plain paper which had not been impregnated was also tested.

The results of the tests are set forth below in Table V.

From the above table, it should be apparent that the minimum uncalendered density of the paper web prior to impregnation should be greater than the 6.9 lbs/mil as in sample B. The maximum uncalendered impregnation density should not exceed the 11.0 lbs/mil value as in sample I. It is noted that even though sample B contained 48.5% impregnant, it was unsatisfactory from an oil barrier standpoint. Although sample J had excellent oil barrier properties, it acquired 9.1% of impregnant but possessed very low tear strength. It is further noted that each of the papers which was satisfactory had a finished uncalendered density in excess of 10.5 lbs/mil and less than about 14.0 lbs/mil.

EXAMPLE VI

The amount of polymer-filler impregnant which is necessary to provide a satisfactory paper is exemplified in the present example wherein a base paper fabricated from Northern bleached kraft pulp and containing approximately 5% titanium dioxide was employed. Although the paper was unsized there was a slight sizing effect due to some residual pitch; however, this was not believed sufficient to have prevented penetration of the impregnant into the interior of the sheet. The basis weight of the paper was 34.6 lbs (24 × 36 — 500 sheets). The samples were prepared as set forth in Example V; however, the solids content of the impregnant was varied from 10 to 40%.

The results of the test are set forth in Table VI.

TABLE V

| Paper | Unimpregnated Basis Wt. (#) | Unimpregnated Density lb./mil* | Sheets Impregnated With 40% $CaCO_3$/60% PVAC impregnant (%) | PVAC/$CaCO_3$ lb./mil* | Tear (XD) (g.) | Oil Barrier | Fold (XD) (f) | Plain Sheets Tear (XD) (g.) | Plain Sheets Fold (f) | Sheets Impregnated With 100% PVAC Tear (XD) (g.) | Fold (f) | Oil Barrier |
|---|---|---|---|---|---|---|---|---|---|---|---|---|
| A | 30.6 | 5.5 | 45.8 | 9.7 | 52 | None | 594 | 32 | 10 | 38 | 821 | None |
| B | 31.9 | 6.9 | 48.5 | 11.3 | 65 | Poor | 2774 | 74 | 11 | 67 | — | Poor |
| C | 34.6 | 7.3 | 47.7 | 12.3 | 94 | Excellent | 3200 | — | — | — | — | Good |
| D | 42.7 | 8.4 | 33.5 | 11.0 | 66 | Fair | 3221 | 78 | | 60 | 2207 | Fair |
| E | 38.2 | 9.1 | 29.3 | 11.1 | 50 | Excellent | 2687 | 118 | | 46 | 2291 | Excellent |
| F | 51.8 | 9.4 | 38.2 | 12.1 | 117 | Good | 5585 | 147 | | 80 | 3171 | Excellent |
| G | 34.6 | 9.8 | 36.2 | 12.3 | 50 | Excellent | 3221 | 64 | 153 | 46 | 2207 | Excellent |
| H | 34.6 | 10.3 | 26.9 | 12.4 | 56 | Excellent | 1351 | 61 | 93 | 53 | 958 | Excellent |
| I | 33.6 | 11.0 | 25.5 | 14.1 | 52 | Good | 704 | 50 | 199 | 56 | 350 | Good |
| J | 38.6 | 12.9 | 9.1 | 14.2 | 30 | Excellent | 3621 | 25 | 2247 | 34 | — | Excellent |

*uncalendered

TABLE VI

| Sample | Polymer-Filler Content | Resin Content and Physical Properties 60% PVAC/40% $CaCO_3$ Impregnated Density (lb./mil)* | Fold (f) | Tear (g) | Oil Barrier | Impregnating Solution Solids Content (%) |
|---|---|---|---|---|---|---|
| A.[1] | 0% | 10.3 | 65 | 58 | None | |
| B. | 6.0% | 10.3 | 1141 | 53 | Fair | 10 |
| C. | 11.1% | 10.7 | 1874 | 51 | Good | 15 |
| D. | 15.6% | 11.0 | 3069 | 56 | Excellent | 20 |
| E. | 24.0% | 12.5 | 2915 | 51 | Total | 30 |
| F. | 20.6% | 12.3 | 1731 | 56 | Total | 40 |

TABLE VI-continued

| Sample | Polymer-Filler Content | Resin Content and Physical Properties 60% PVAC/40% $CaCO_3$ Impregnated Density (lb./mil)* | Fold (f) | Tear (g) | Oil Barrier | Impregnating Solution Solids Content (%) |
|---|---|---|---|---|---|---|
| G.[2] | 30.2% | 13.0 | 831 | 53 | Total | |

[1]Base paper
[2]100% PVAC only.
*uncalendered

From the above data, it should be apparent that a significant improvement in oil barrier properties and folding endurance properties occurs when the polymer-filler impregnant constitutes between about 6–10%, or about 8.5% of the weight of the sheet (sample B) with highly desirable properties resulting when the impregnant is in a range between 15–25% of the weight of the sheet, as indicated in samples D and E, and up to about 48% as indicated in Example I (page 19, infra).

EXAMPLE VII

In order to demonstrate the different types of rigid polymeric materials which may be employed satisfactorily in manufacturing paper of the present invention, sheets of the base paper of Example I were impregnated with a polymer-filler dispersion having a solids content of 40% by weight, with the weight ratio of polymer to filler being 60 to 40%. The filler was calcium carbonate, and the polymers included: RHOPLEX AC-201, a polyacrylate emulsion manufactured by Rohm & Haas Co., Philadelphia, Pa.; and GEON 351, a polyvinyl chloride emulsion manufactured by the B.F. Goodrich Chemical Co., Akron, Ohio.

The test results are summarized below in Table VII.

TABLE VII

| Impregnant | Polymer | Evaluation Of Various Types Of Polymers Impregnant Extended With 60/40 Polymer/ $CaCO_3$ and Unextended Impregnant Rigidity (Tg.) | Impregnant Content (%) | Impregnated Density (lb./mil)* | Tear (g) (XD) | Fold (f) (XD) | Burst (psi) Mullen | Oil Barrier | Solvent Resistance |
|---|---|---|---|---|---|---|---|---|---|
| RHOPLEX[1] Ac201/$CaCO_3$ | Poly-acrylate | 29° | 32.7 | 13.0 | 94 | 1761 | 73 | Excellent | Good |
| RHOPLEX[2] Ac/201 only | Poly-acrylate | 29° | 42.0 | 14.0 | 83 | 1226 | 80 | Excellent | Excellent |
| GEON[1] 351/$CaCO_3$ | Polyvinyl chloride | 60° | 42.0 | 13.6 | 96 | 672 | 64 | Good | Fair |
| GEON[2] 351 only | Polyvinyl chloride | 60° | 43.2 | 12.9 | 89 | 297 | 50 | Poor | Poor |

[1]Impregnant extended 60/40 polymer/$CaCO_3$.
[2]Impregnant not extended.
*uncalendered From the above data, it should be apparent that an impregnant consisting of a rigid polyacrylate material extended with calcium carbonate has substantially the same effect on a base paper as a rigid polyvinyl acetate and calcium carbonate impregnant (compare Tables I and VII). It is noted that similar results are obtained when the impregnant consists of a blend of polyvinyl chloride extended with calcium carbonate; however, the solvent resistance and oil barrier properties of the impregnated paper are actually higher with the extended impregnant than with the unextended impregnant. Accordingly, it should be apparent that beneficial results can be achieved only by employing certain types of rigid polymeric materials such as polyvinyl acetate, polyacrylate, and polyvinyl chloride.

EXAMPLE VIII

The paper of the present invention has good abrasion resistance even though the impregnant blend is extended with significant percentages of filler and even though considerably less than half of the weight of the paper is provided by the impregnant. In determining the abrasion resistance of the paper of the present invention, sheets of the base paper of Example I were impregnated with various rigid polymers and polymer-filler blends in accordance with the procedure of Example I. The polyvinyl acetate polymer was VINAC 880; the polyacrylate polymer was RHOPLEX 407; and the polyvinyl chloride was GEON 351. The sheets were subjected to the Tabor Abrasion Test according to TAPPI Standard procedures (TAPPI T 476 ts-63). An H-18 abrasive wheel was utilized in the test, and the number of cycles of rotation of the wheel until a hole was worn in the sheet were counted. The results are set forth in Table VIII.

TABLE VIII

| Impregnant | Comparative Taber Abrasion Roughness H-18 Wheel Cycles To Failure | Impregnant Content % |
|---|---|---|
| Polyvinyl Acetate only | 600 | 31.7 |
| Polyvinyl Acetate/ 30% $CaCO_3$ | 530 | 32.2 |
| Polyvinyl Acetate/ 30% Clay | 800 | 32.0 |
| Polyacrylate only | 1500 | 39.5 |
| Polyacrylate/40% $CaCO_3$ | 1700 | 28.3 |
| Polyvinyl Chloride only | 354 | 43.2 |
| Polyvinyl Chloride/40% $CaCO_3$ | 400 | 42.0 |
| Untreated Base Paper | 20–50 | 0 |

From the above data, it should be apparent that the abrasion resistance of a paper sheet which has been impregnated with a blend of a rigid polyvinyl acetate and a mineral filler such as calcium carbonate, is only slightly less (530 cycles) than a paper sheet impregnated with polyvinyl acetate only (600 cycles). A sheet impregnated with polyvinyl acetate extended with clay in the stated proportions has even greater abrasion resistance than does a sheet impregnated with polyvinyl acetate only. A sheet impregnated with a polyacrylate material extended with calcium carbonate also has a higher abrasion resistance than does a sheet impregnated only with the polyacrylate. The abrasion resistance of a sheet impregnated with a filler-extended blend of polyvinyl chloride has slightly greater abrasion resistance (400 cycles) than does a similar sheet impregnated with the polyvinyl chloride only.

EXAMPLE IX

The paper of the present invention must be impregnated with the above-noted dispersion; it cannot be produced merely by applying the dispersion as a coating. To demonstrate this, sheets of a base paper having a basis weight of 54.1 lbs. (500 sheets 24 × 36inch) and a caliper of 5.5 mils, were impregnated and coated with the polymer-filler composition. For example, a sheet of base paper was impregnated with the composition described in Example I, and another sheet of the base paper was coated with the same composition in the manner described in Example I of U.S. Pat. No. 3,634,298, except that Vinac 880 polyvinyl acetate having a Tg of 31° C. was substituted for the polymer synthesized in Example I of the patent to form the aqueous clay-polymer dispersion. The dispersion comprised 55%, by weight, of the clay-polymer blend in a ratio of 83% clay to 17% polymer. The resulting dispersion was applied to one side of the base paper as a coating, using a Meyer bar, as described in Example I of the patent. The coated paper was thereafter dried for 1 minute at 300° F.

The coated and impregnated papers were later tested for tear, burst and fold properties, and the results of the tests are set forth in Table IX.

TABLE IX

| Sample | % Vinac Pigment | Caliper mils | Density lbs/mil | Tear Grams (XD) | Mullen psi | Fold 10–20% rel. hum. | Fold 90% rel. hum. | Delamination Resistance gm/mil |
|---|---|---|---|---|---|---|---|---|
| Base Paper | 0 | 5.5 | 9.8 | 115 | 32.8 | 502 | 1633 | 200 |
| Base Paper, Impregnated | 303 | 5.42 | 14.3 | 89 | 76.4 | 1284 | 7018 | 800 |
| Base Paper, Coated | 24.7 | 6.31 | 11.4 | 136 | 48.0 | 356 | 1065 | 200 |

From the foregoing table, it may be seen that impregnation decreased tear strength about 13% while coating increased tear strength by about 12%. Impregnation more than doubled burst strength while coating only increased burst strength by about 50%. In the fold test, impregnation considerably more than doubled the fold endurance (even at the lower 10–20% relative humidity) whereas coating actually decreased the fold endurance by about 30%. The delamination resistance of the coated paper was the same as the base paper; however, the delamination resistance of the impregnated paper measured in excess of 800 grams/inch, at which point the paper actually tears and does not delaminate. Hence, from the foregoing data, it should be apparent for the polymer-filler blend must be impregnated in the paper web rather than merely being applied on the surface as a coating.

In view of the foregoing description and examples, it should be apparent that the present invention provides a novel dense paper which possesses the desirable properties of dense papers without the undesirable properties thereof rendering the paper useful in many applications. Moreover, the dense papers of the present invention are capable of being manufactured ecomonically at relatively high papermaking machine speeds.

Accordingly, while a preferred embodiment of the present invention has been described in detail, various modifications, alterations or changes may be made without departing from the spirit and scope of the present invention as defined in the appended claims.

I claim:

1. A dense paper, comprising: a web of cellulosic fibers having an impregnant dispersed throughout the web, said web having a pre-impregnation density in a range of 7–11 lbs./mil and containing after impregnation from about 8.5 to about 50%, by weight, of the impregnant, based on the dry weight of the impregnated web, and said impregnant consisting essentially of from about 35 to about 90% of a rigid polymeric material and from about 10 to about 65% of an inorganic filler, said polymeric material having a glass transition temperature in a range of between about 15° to about 60° C, and said percentages of polymeric material and filler being by weight based on the weight of said impregnant.

2. A paper according to claim 1 wherein said filler is selected from the group of minerals consisting of: clay, calcium carbonate, mica, and talc or blends thereof.

3. The paper according to claim 1 wherein said glass transition temperature is in a range of between about 22° to about 44° C.

4. The paper according to claim 1 wherein said paper has a finished uncalendered density of at least about 10.5 lbs/mil and less than about 14.0 lbs/mil based on 500 sheets 24 × 36.

5. The paper according to claim 1 wherein said impregnant is in a range of between about 15 to about 40% of the finished weight of said paper.

6. The paper according to claim 1 wherein said filler is in a range of between about 20 to about 65% of the weight of said impregnant.

7. The paper according to claim 1 wherein said polymeric material is selected from the group of polymeric materials consisting of: polyvinyl acetate, polyacrylate, and polyvinyl chloride or mixtures thereof.

8. The paper according to claim 7 wherein said selected polymeric material includes copolymers and homopolymers thereof.

9. A dense paper, comprising: a web and a blend dispersed throughout the web, said blend including a rigid polymeric material having a glass transition temperature in a range of about 15° to about 60° C and a compatible filler, the weight of the blend in the web being in a range of about 8.5 to about 50% of the finished dry weight of the paper, said blend consisting essentially of from about 35 to about 90% of said rigid polymeric material and from about 10% to about 65% of said compatible filler, said paper having a finished uncalendered density in a range of about 10.5 lbs./mil to about 14.0 lbs./mil, said percentages of polymeric material and filler being by weight based on the weight of the blend in the web.

10. A dense paper, comprising: a web having a blend of a rigid polymeric material and a compatible filler dispersed therein, said blend being in a range of between about 8.5% to about 50% by weight, based on the dry finished weight of the paper, said blend having been distributed in the paper by impregnation of a cellulosic fiber web having a pre-impregnation density in a range of about 7 to about 11 lbs./mil, said blend consisting essentially of from about 35 to about 90% of said rigid polymeric material and from about 10 to about 65% of said compatible filler, said percentages of said rigid polymeric material and said filler being by weight based on the weight of the blend in the web.

11. The paper according to claim 10 wherein said rigid polymeric material has a glass transition temperature in a range of about 15° to about 60° C and is selected from the group consisting of: polyvinyl acetate, polyacrylate, and polyvinyl chloride or mixtures thereof, and said filler is selected from the group consisting of: clay, calcium carbonate, mica, and talic or blends thereof.

12. A dense paper, comprising: an impregnated cellulosic fiber web having a pre-impregnation density in a range of about 7 to about 11 lbs./mil and containing an impregnant consisting essentially of a rigid polymeric material having a glass transition temperature in a range of about 22° to about 44° C blended with a compatible filler, said impregnant constituting between about 15 to about 40% of the dry finished weight of the paper, and said impregnant consisting essentially of from about 20 to about 65% of said filler based on the weight of the impregnant.

13. A dense paper, comprising: a cellulosic fiber web and a blend dispersed in the web, said blend consisting essentially of a rigid polymeric material having a glass transition temperature in a range of about 22° to about 44° C and an inorganic filler, the weight of the blend in the web being in a range of about 10 to about 25% of the finished dry weight on the paper, said rigid polymeric material in said blend constituting between about 80 to about 40% of the weight of the blend in the web, and said paper having a finished uncalendered density in a range of about 10.5 to about 14 lbs./mil.

* * * * *

UNITED STATES PATENT OFFICE

CERTIFICATE OF CORRECTION

Patent No. 4,058,648 Dated November 15, 1977

Inventor(s) William G. Louden

It is certified that error appears in the above-identified patent and that said Letters Patent are hereby corrected as shown below:

Column 1, line 16, change "grease-proff" to --grease-proof--;

Column 5, line 14, delete the extra "and";

Column 8, line 7, change "non-dring" to --non-drying--;

In Table IV, column 2, change "34.5" to --34.3--;

In Table V, column 2, change "(#)" to --(1b.)--;

In Table IX, column 2, change "303" to --30.3--.

Signed and Sealed this

Seventh Day of March 1978

[SEAL]

Attest:

RUTH C. MASON
Attesting Officer

LUTRELLE F. PARKER
Acting Commissioner of Patents and Trademarks